US007878367B2

(12) United States Patent
Simon et al.

(10) Patent No.: US 7,878,367 B2
(45) Date of Patent: Feb. 1, 2011

(54) BLISTER PACK SYSTEM WHICH ASSURES A RELIABLE CONTACT MAKING WHEN AN ITEM IS REMOVED

(76) Inventors: Udo Simon, Virchowstrasse16, Nuernberg (DE) 90409; Ernst-Rudolf Radtke, Gablonzer Strasse 6, Lauf a.d. Pegnitz (DE) 91207

( * ) Notice: Subject to any disclaimer, the term of this patent is extended or adjusted under 35 U.S.C. 154(b) by 1246 days.

(21) Appl. No.: 10/559,842

(22) PCT Filed: Jun. 15, 2004

(86) PCT No.: PCT/DE2004/001213

§ 371 (c)(1),
(2), (4) Date: Dec. 7, 2005

(87) PCT Pub. No.: WO2004/112686

PCT Pub. Date: Dec. 29, 2004

(65) Prior Publication Data

US 2007/0095715 A1 May 3, 2007

(30) Foreign Application Priority Data

Jun. 16, 2003 (DE) ..... 103 27 022

(51) Int. Cl.
*G07F 11/66* (2006.01)
*B65D 83/04* (2006.01)
*B65D 85/42* (2006.01)

(52) U.S. Cl. ..... 221/25; 221/5; 221/253; 221/2; 221/6; 221/7; 221/3; 221/1; 221/123; 206/531; 368/10; 368/107; 116/308; 74/513

(58) Field of Classification Search ..... 221/25, 221/5, 253, 2, 6, 7, 3, 1, 123; 206/531; 368/10, 368/107; 116/308; 74/513
See application file for complete search history.

(56) References Cited

U.S. PATENT DOCUMENTS 3,921,804 A * 11/1975 Tester ..... 206/531
4,526,474 A * 7/1985 Simon ..... 368/10
4,662,537 A * 5/1987 Wolf et al. ..... 221/89
4,858,207 A * 8/1989 Buchner ..... 368/10

(Continued)

FOREIGN PATENT DOCUMENTS

WO WO 9111167 A1 * 8/1991
WO WO 02/083057 A1 * 10/2002

*Primary Examiner*—Gene O. Crawford
*Assistant Examiner*—Rakesh Kumar
(74) *Attorney, Agent, or Firm*—Robert Lelkes

(57) ABSTRACT

A blister pack system has an upper part and a bottom part, between which a blister pack is disposed. Pouches of the blister pack are aligned with corresponding ejection openings of the upper part and corresponding ejection openings of the bottom part. Every ejection opening of the upper part is associated with an individual contact surface that can be connected to a control/computing unit via an individual strip conductor. The system includes an ejection device, which at a top section has an electrical contact, and at a peg section an additional electrical contact which is electrically connected to the electrical contact of the top section. The individual contact surfaces and the individual strip conductors associated therewith, as well as a common contact surface and a common strip conductor associated therewith or a subsection thereof extend in surfaces of the upper part that are electrically isolated from each other.

22 Claims, 10 Drawing Sheets

U.S. PATENT DOCUMENTS 5,186,633 A * 2/1993 Mosser, III ..... 439/79
5,348,158 A * 9/1994 Honan et al. ..... 206/531
6,411,567 B1 * 6/2002 Niemiec et al. ..... 368/10
7,035,168 B2 * 4/2006 Niemiec et al. ..... 368/10
7,198,173 B2 * 4/2007 Simon ..... 221/25
7,353,969 B2 * 4/2008 McHutchinson ..... 221/88
2005/0226100 A1 * 10/2005 Simon et al. ..... 368/10
2007/0084746 A1 * 4/2007 Udo et al. ..... 206/531

* cited by examiner

Raum für Elektronik: Space for the electronics

BLISTER PACK SYSTEM WHICH ASSURES A RELIABLE CONTACT MAKING WHEN AN ITEM IS REMOVED

CROSS-REFERENCE TO RELATED APPLICATION

This is a nationalization of PCT/DE04/001213 filed Jun. 15, 2004 and published in German.

BACKGROUND OF THE INVENTION

1. Field of Invention

The present invention relates to a blister pack system having an upper part and a bottom part, between which a blister pack is disposed. Pouches of the blister pack are aligned with corresponding ejection openings of the upper part and corresponding ejection openings of the bottom part. Every ejection opening of the upper part is associated with an individual contact surface that can be connected to a control/computing unit via an individual strip conductor.

2. Description of the Prior Art

Such blister pack systems are known from prior art. For example, the patent application EP 1 214 924 A2 describes a blister pack system in which a blister pack can be disposed between an upper part and a bottom part. Ejection openings corresponding to the pattern of the coated pills are arranged in the upper part and in the bottom part. An ejection device is provided that can carry out a linear movement and a rotatory movement in relation to the upper part. The ejection device comprises an ejection pusher that can be inserted selectively into a certain ejection opening of the upper part for removing a corresponding coated pill. Furthermore, the ejection device comprises a contact element that bridges a pair of contact points with a contact panel in the respective certain ejection position of the ejection pusher for the purpose of indicating the certain ejection position. One contact point of each pair of contact points associated with an ejection opening of the upper part is connected to a common strip conductor that leads to an evaluation electronic unit. The other contact point of each pair of contact points is connected to the electronic unit via an individual strip conductor. In the event that the contact panel of the ejection device bridges both the contact points of a pair of contact points during the removal of the coated pills, an electric circuit is closed that leads from the electronic unit via the common strip conductor, the corresponding contact panel and the corresponding individual strip conductor back to the electronic unit. A removal signal indicating the removal of the coated pills is generated by a current flow via this electric circuit.

One problem of such a device is that a defective alarm signal is generated if an electro-conductive part enters into the blister pack system and bridges a pair of contact points in an undesired manner.

SUMMARY OF THE INVENTION

The object of the present invention is to design a blister pack system so as to largely prevent the activation of defective removal signals caused by the effect of foreign bodies.

This object is achieved by a blister pack system having the characteristics described herein.

The essential advantage of the present invention is that the present blister pack system is designed in such a way that it is possible to prevent any defective indication of removal signals that can be attributed to the fact that foreign bodies impinge on the blister pack system and short-circuit the contact points, for example, when the blister pack system is carried along in a handbag or the like. This ensures that a patient is most reliably reminded to take the medicines, indication errors are avoided and additionally the data about the timepoints of the removal of the pills can be reliably stored in the electronic unit for evaluation.

An additional essential advantage of the present invention is that the strip conductors, namely both the individual strip conductors as well as the common strip conductor and the interface between the contact points of the strip conductors and the contact points leading to the electronic unit can be manufactured easily and safely. Thus the entire manufacturing process of the blister pack system can be substantially simplified and designed to be more cost-effective.

Preferred embodiments of the present invention are as specified herein.

BRIEF DESCRIPTION OF THE DRAWINGS

The present invention and its embodiments are explained more elaborately in the following description in conjunction with the figures of which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
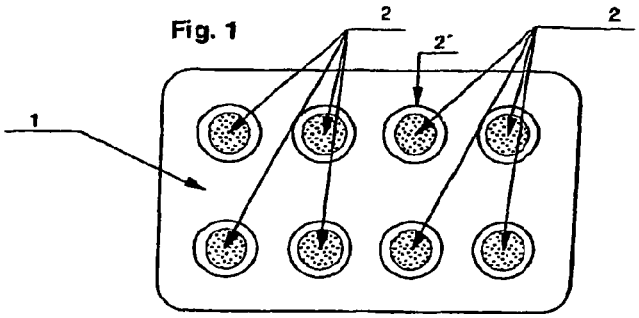
FIG. 1 illustrates a top view of a known blister pack for medicinal products.

FIG. 1 illustrates a blister pack 1 that is known per se and that contains preferably medicinal products in solid form, especially tablets or coated pills 2 in individual pouches 2'.

Figure 2:
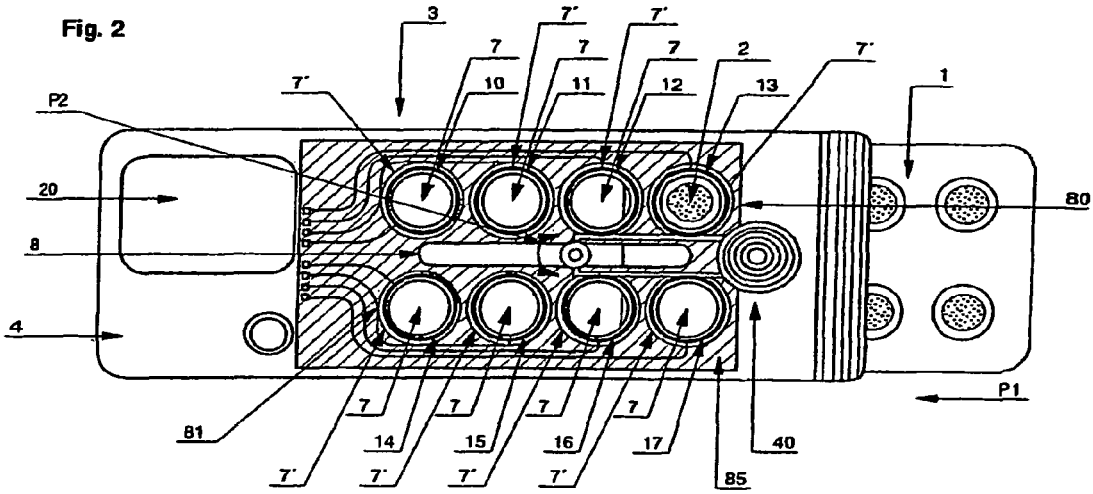
FIG. 2 illustrates a top view of a receiving device of a first embodiment of the blister pack system according to the present invention where the blister pack is inserted into the receiving device and where the ejection device is located in the stand-by position.
Figure 14:
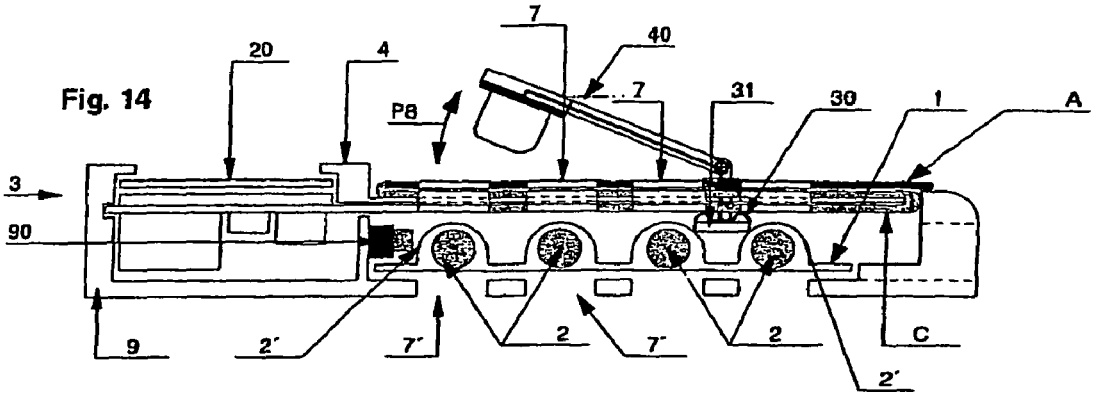
FIG. 14 illustrates a section through the arrangement shown in FIG. 13, where the ejection pusher is located above the ejection position.
Figure 15:
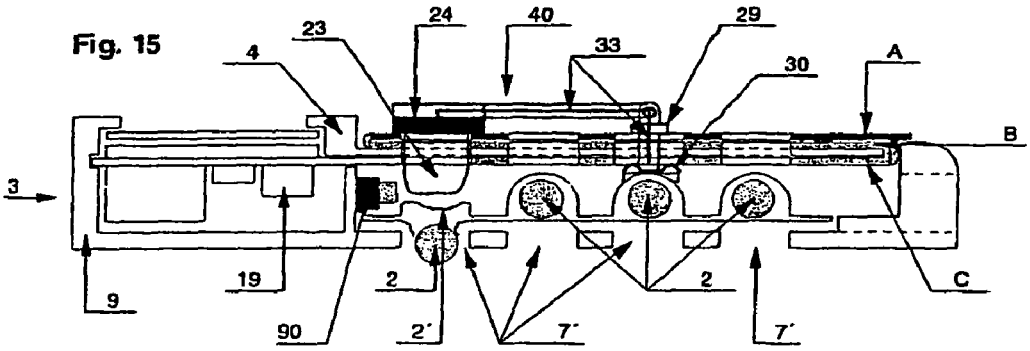
FIG. 15 illustrates a section through the receiving device that corresponds to that shown in FIG. 14 where the ejection pusher is inserted into an ejection opening for removing a coated pill from the blister pack.

As illustrated in FIGS. 2 to 5, the present receiving device 3 for receiving a blister pack 1 essentially consists of an upper part 4 and a bottom part 9 (FIGS. 14, 15) between which the blister pack 1 can be disposed, for example, inserted in the direction of the arrow P1 as shown in FIG. 2.

When the blister pack 1 is received in the receiving device 3 (FIG. 2) between the upper part 4 (FIGS. 2, 7, 14) and the bottom part 9 (FIG. 14), the pouches 2' of the blister pack 1 are aligned with the ejection openings 7 of the upper part 4 (FIG. 2) and additional ejection openings 7' of the bottom part 9. The upper part 4 comprises a guide slot 8 for an ejection device 40, which is explained more elaborately later in conjunction with the FIGS. 6, 6*a* and 6*b*.

The ejection device 40 (FIG. 6) has a top section 25 having a pusher part 23 that can be inserted for removing the coated pills through a selected ejection opening 7 of the upper part 4 and through a pouch 2' of the blister pack 1 that is aligned with said ejection opening 7. Said pusher part 23 can move to the ejection opening 7' of the bottom part 9 (FIG. 14) that is aligned to the pouch 2'.

In a manner that is known per se, the upper part 4 contains, preferably on its side lying opposite to the insertion side for the blister pack 1, an electronic unit that comprises a display 20 in particular and a control/computing unit 19.

Figure 5:
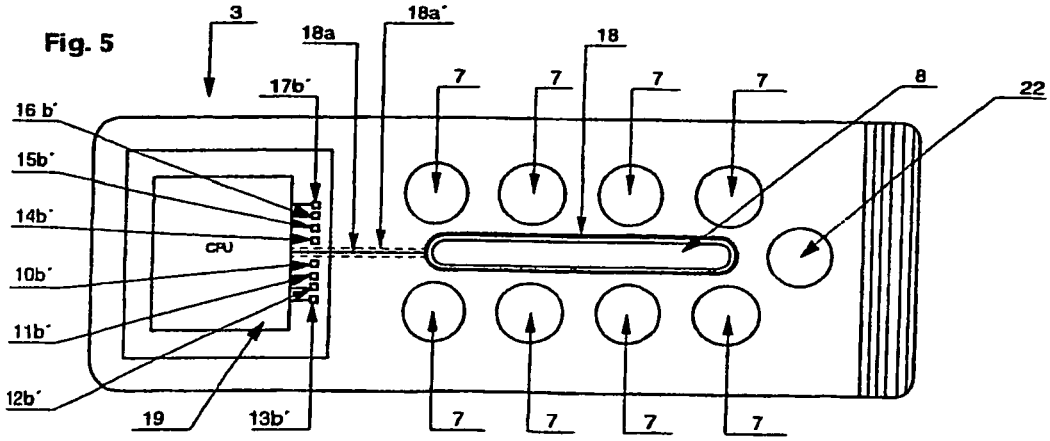
FIG. 5 illustrates a view of the lower surface of the upper part that comprises an annular, common contact surface that is arranged around the guide slot and is connected to the electronic unit.

In order to achieve the protection described above from the generation of defective signals, an individual contact surface 10, 11, 12, 13, 14, 15, 16 and 17 is associated with every ejection opening 7. Said individual contact surface (10 to 17) preferably has the shape of a closed, electro-conductive ring surrounding the ejection opening 7. Every individual contact surface 10 to 17 is connected to an individual strip conductor 10*a*, 11*a*, 12*a*, 13*a*, 14*a*, 15*a*, 16*a* and 17*a* (FIG. 4) that leads to an individual contact surface 10*b*, 11*b*, 12*b*, 13*b*, 14*b*, 15*b*, 16*b* and 17*b*. Said individual contact surfaces (10*b* to 17*b*) are arranged preferably transversely to the guide slot 8 in a row located in the vicinity of the electronic unit. Each of the individual contact surfaces 10*b* to 17*b* is connected via a through-connection to a corresponding individual contact surface 10*b*', 11*b*', 12*b*', 13*b*', 14*b*', 15*b*', 16*b*' and 17*b*' that can be located on the lower surface of the upper part 4, as illustrated in FIG. 5.

Figure 3:
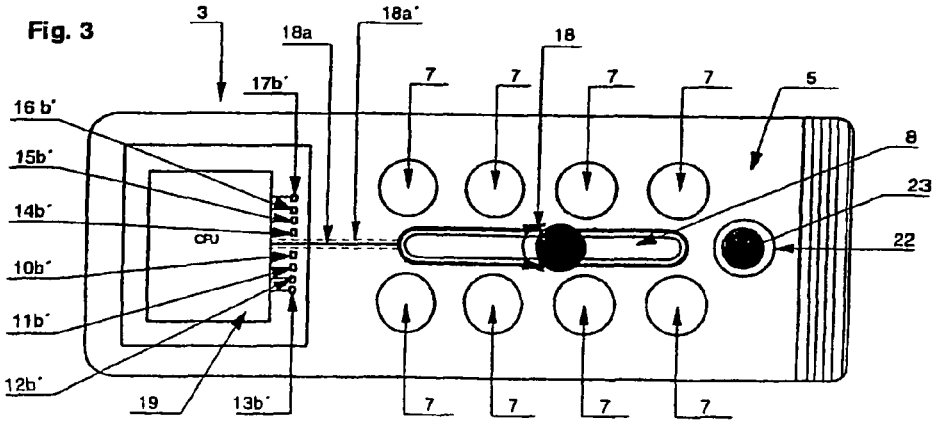
FIG. 3 illustrates a view of the lower surface of the upper part of the receiving device illustrated in FIG. 2 where the ejection pusher is located in the stand-by position.
Figure 4:
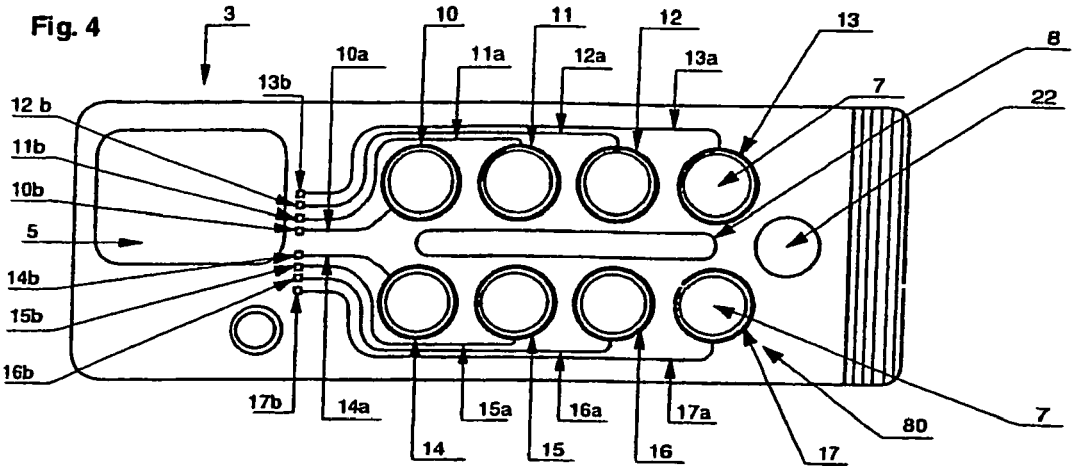
FIG. 4 illustrates a view of the top surface of the upper part where the contact surfaces are each connected to individual strip conductors that lead to contact points which create a through-connection to the lower surface of the upper part.

The guide slot 8 of the upper part 4 is surrounded by an annular common contact 18 that is arranged on the lower surface of the upper part 4 and that is connected to a common strip conductor 18*a*, which extends to the electronic unit (FIG. 3).

Figure 6:
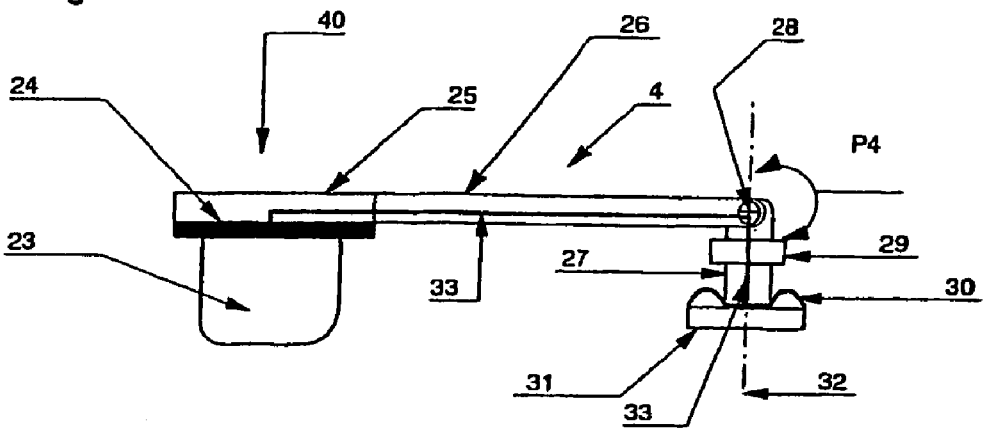
FIG. 6 illustrates the ejection device that comprises an ejection pusher, a top section and a peg section where the peg section that can be moved linearly in the guide slot and where the ejection pusher can be deviated around the axis of the peg section.
Figure 6A:
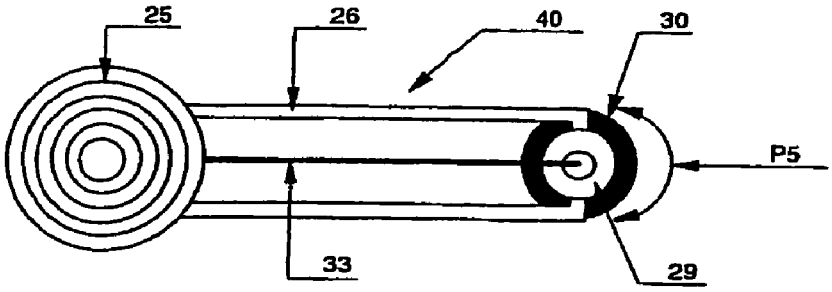
FIG. 6*a* illustrates the ejection device from the top.
Figure 6B:
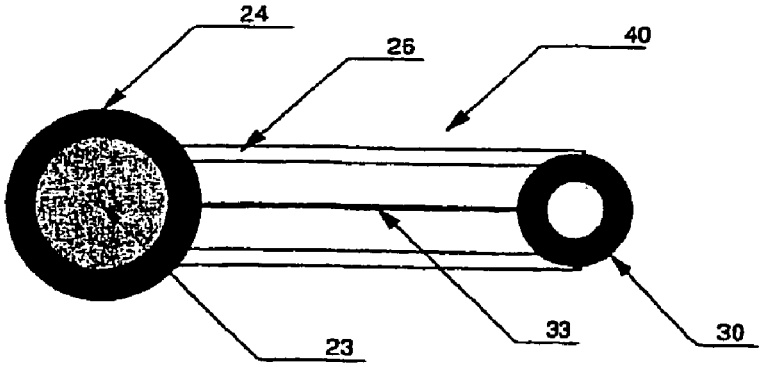
FIG. 6*b* illustrates the ejection device from the bottom.
Figure 7:
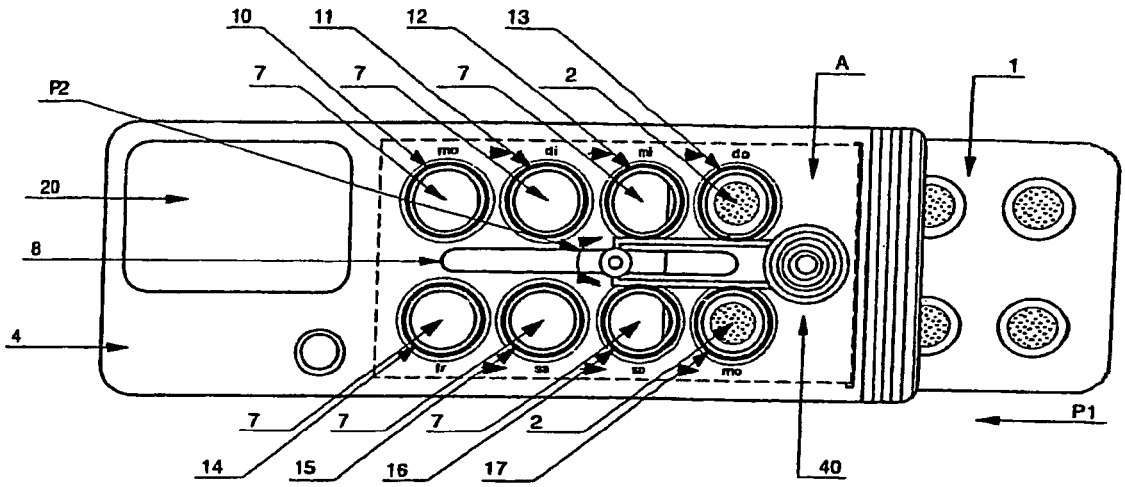
FIG. 7 illustrates a top view of the receiving device of a second embodiment of the blister pack system according to the present invention where the ejection device is located in the stand-by position.
Figure 8:
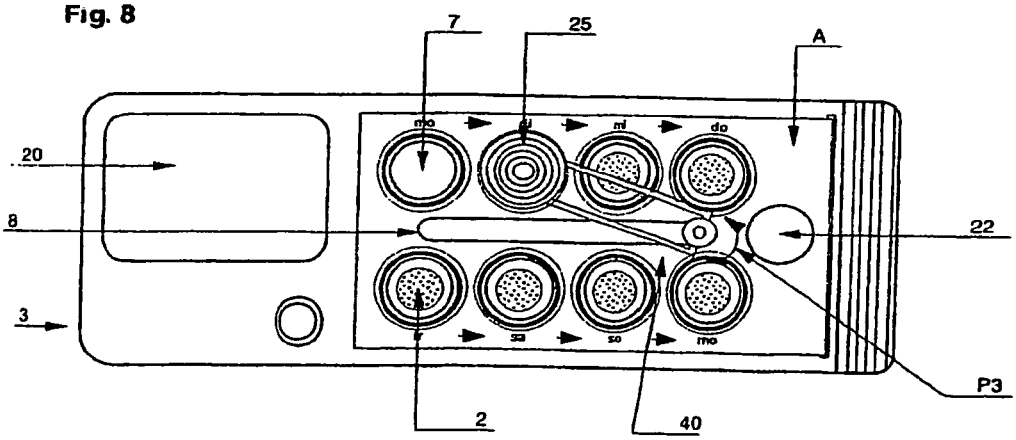
FIG. 8 illustrates a view of the top surface of the upper part of the receiving device shown in FIG. 7 where the ejection device is located in a removal position.

As illustrated in FIG. 6, the ejection device 40 comprises the afore-mentioned top section 25 with the pusher part 23 where the top section 25 is connected to a peg section 27 by means of a part 26. The part 26 is arranged in the peg section 27 such that it 26 can deviate around the axis 28 extending parallelly to the plane of the upper part 4. The peg section 27 has a sliding part 29 that slides on the top surface of the upper part 4 on the edge region of the guide slot 8 when the peg section 27 penetrating the guide slot 8 is moved in the guide slot 8. At a distance from the sliding part 29, the peg section 27 preferably comprises a resilient contact ring 30 that is arranged on a holding part 31, which is attached to the end of the peg section 27. As mentioned earlier, in the assembled state, the sliding part 29 resting on the upper part 4 slides on the edge region of the guide slot 8 during a movement of the peg section 27 moves where the contact ring 30 rests preferably resiliently against the lower surface of the upper part 4 and electrically contacts the common contact 18 (FIG. 3).

The contact ring 30 is connected via an electro-conductive connection 33, which preferably extends through the peg section 27 and the part 26, to a contact ring 24 of the top section 25. Said contact ring 24 is preferably provided with an annular shape and is designed on a shoulder between the top section 25 and the pusher part 23. In this way, in every removal position, an electrical connection is created between an individual contact surface 10 to 17 (FIG. 2) corresponding to the respective removal positions and the common contact 18 (FIG. 3) and thus between an individual contact surface 10*b*' (FIG. 3) and the common strip conductor 18*a* (FIG. 3). In other words, in every removal position an individual connection is created for indicating this position between an individual contact surface 10*b*' to 17*b*' and the common strip conductor 18*a*.

The electrical connection 33 preferably has the form of a wire that extends starting from the contact ring 30 of the peg section 27 through the peg section 27 via the part 26 to the contact ring 24 of the top section 25.

It must be pointed out here that the actual contacts between the common strip conductor 18*a* and the individual contact surfaces 10*b*' to 17*b*' and the control/computing unit 19 of the electronic unit are not shown in the embodiment illustrated in the FIGS. 2 to 5. Instead these contacts are effected inside the small box representing the control/computing unit 19 of the electronic unit.

In the context of the present invention, it is of special significance that due to the arrangement of strip conductors and contact surfaces on both sides of the upper part 4 and the special design of the ejection device 40 having an electrical connection 33 between the contact ring 24 of the top section 25 and the resilient contact ring 30 of the peg section 27, it is possible to completely decouple the strip conductors from the contact surfaces so as to eliminate the possibility of any such false alarms regarding the removal of medicinal products that can be caused in the presently available receiving devices when the devices are carried along, for example in ladies' handbags or the inside pockets of coats, etc., if strip conductors and/or contact surfaces that are arranged on one plane are short-circuited by electro-conductive parts, such as e.g. paper clips or tinfoils, etc.

In the embodiment described here, it is possible to completely eliminate the possibility of false alarms if the common strip conductor 18*a* is covered, as indicated schematically in FIGS. 3 and 5, using an insulating layer 18*a*', for example an insulating varnish so as to completely rule out the possibility of any contact to the contact surfaces 10*b*' to 17*b*'.

As illustrated in FIG. 2 (hatched area) it is feasible to cover the surface of the upper part 4 using an insulating layer 85, preferably a sturdy plastic film in such a way that the individual strip conductors 10*a* to 17*a* are covered with an electrical insulation, where the layer 85 comprises recesses in which the individual contact surfaces 10 to 17 are exposed for contacting by the contact ring 24 of the ejection device 40.

Figure 9:
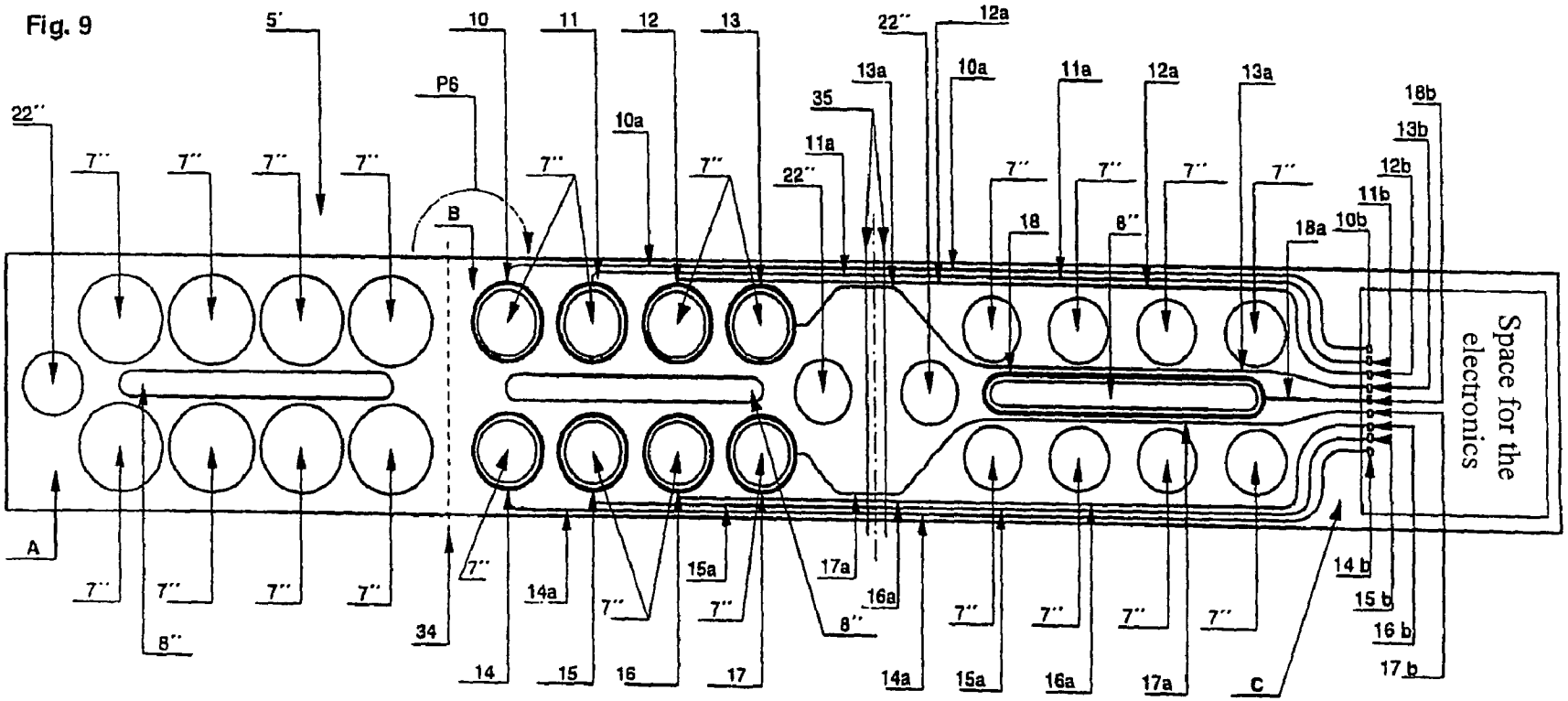
FIG. 9 illustrates a strip conductor part provided for the second embodiment illustrated in FIGS. 12 and 13. Said strip conductor part consists of three sections when seen from one side where a first centrally arranged section shows the arrangement and/or the pattern of the individual contacts and of the individual strip conductors that extend to a second section arranged to the right and where the second section shows the guide slot in particular and the common annular contact surface as well as a sub-section of the individual strip conductors and the contact points that forms an interface for connecting the common contact surface and the individual contact points to the electronic unit and where a third section arranged to the left is provided for covering and protecting the strip conductors of the first section.
Figure 12:
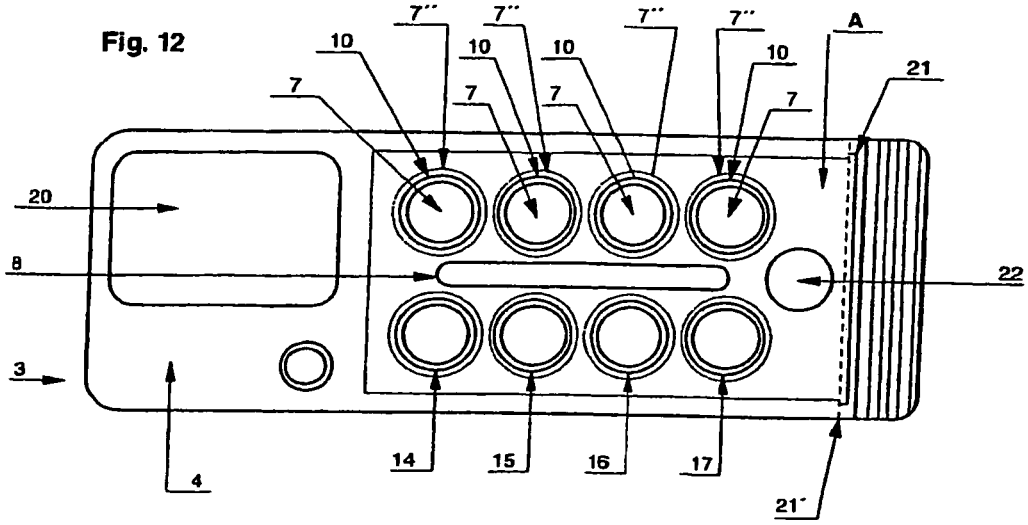
FIG. 12 illustrates the upper part of the receiving device having the first section and the third section of the strip conductor that are arranged on it as well as having a display which is a part of the electronic unit, the guide slot, the ejection openings, the housing opening and the stand-by position.
Figure 13:
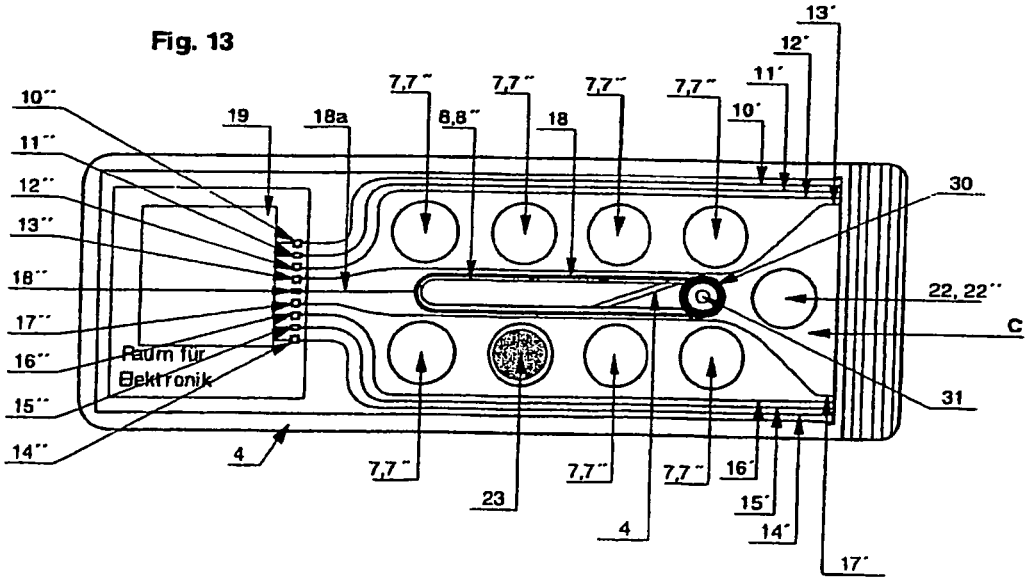
FIG. 13 illustrates the lower surface of the upper part illustrated in FIG. 12 with a view of the second section of the glued strip conductor part where the contact ring of the peg section impinges on the common contact surface and the ejection pusher is located in an ejection opening and stretches through the three sections of the strip conductor part as well as through the upper part arranged between the first, second and third section of the strip conductor part.

In the following description, an additional embodiment of the present invention is explained in conjunction with FIGS. 7 to 13 that is particularly advantageous considering that it is possible to superimpose the strip conductors and contact surfaces from one instead of from two sides because a special strip conductor part 5' (FIG. 9) is provided here. It is clearly evident that such an embodiment is extremely favorable with respect to the manufacturing costs and the manufacturing process. As can be seen in FIG. 9, the strip conductor part 5' consists of three sections A, B and C arranged next to one another where the sections A and B can be folded over one another along a bending line 34 in the direction of the arrow P6 in such a way that the ejection openings 7" corresponding to the pattern of the blister pack 1 and the recess 8" of the section A corresponding to the recess 8 congruently overly the ejection openings 7" and the recess 8" respectively of the section B. It must be pointed out here that the ejection openings 7" of the third section A are bigger than the ejection openings 7" of the first section B so that the individual contact surfaces 10 to 17 are exposed for loading by the contact ring 24 of the ejection device 40. The section B comprises the individual contact surfaces 10 to 17 that were explained in conjunction with the FIGS. 2 and 3 (FIGS. 7, 8, 12, 13) and that surround the ejection openings 7" preferably annularly. The section B also comprises the individual strip conductors 10*a* to 17*a* that have also been explained above. The section B is connected via a bending region 35 to the section C that also comprises ejection openings 7" corresponding to the pattern of the blister pack 1 and a recess 8" corresponding to the recess 8 (FIGS. 12, 13). The recess 8" is surrounded by a common annular contact 18 that leads via a common strip conductor 18*a* to a corresponding contact point 18*b* on which a contact to the electronic unit is to be created. Accordingly, the individual strip conductors 10*a* to 17*a* extend starting from the section B across the bending region 35 on the section C to additional connection contact surfaces 10*b* to 17*b*. Said additional connection contact surfaces 10*b* to 17*b* are arranged preferably with the connection contact point 18*b* in a row extending in an interface in the receiving region of the electronic unit preferably transversely to the common strip conductor 18*a*. The contacting to the electronic unit is made on these additional connection contact surfaces 10*b* to 17*b*.

Figure 10:
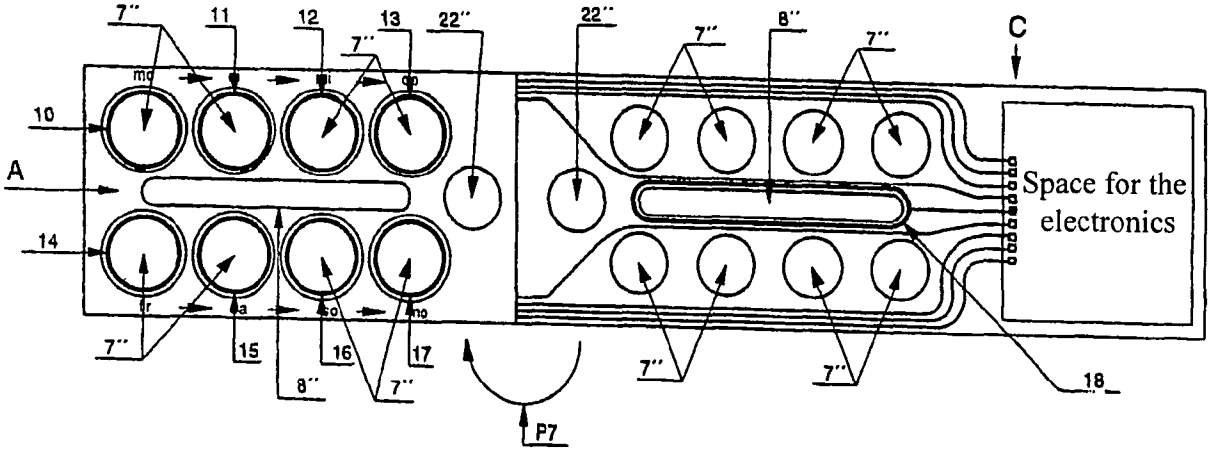
FIG. 10 illustrates the folded third section that is congruently aligned with the first section lying under it, and the second section before being bent.

It can be noticed that all the contact surfaces, strip conductors and connection contact points are arranged on one and the same surface of the sections B and C due to which an expensive through-connection becomes unnecessary. As illustrated in FIG. 9, the strip conductor part 5' having the sections A, B and C is handled in the following manner. In a first step, for example, the section A is folded along the line 34 in the direction of the arrow P6 so that it overlies the section B congruently. The surface of the section A is attached, preferably glued to the surface of the section B. The section A thus covers the segments of the section B of the individual strip conductors 10*a* to 17*a* so that a contact to these strip conductors is not possible. The side of the section B that is turned away from the individual strip conductors 10*a* to 17*a* is attached, preferably glued to the side of the upper part 4 of the receiving device that is turned away from the bottom part. FIG. 10 illustrates the state in which the section A is attached to the section B.

Figure 11:
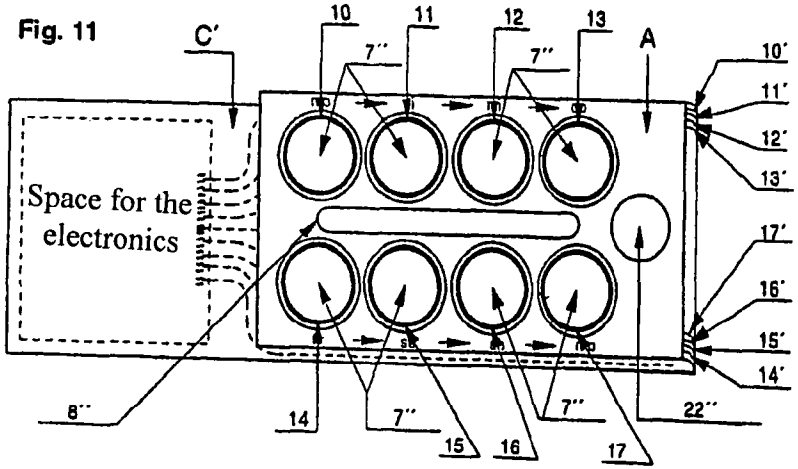
FIG. 11 illustrates the completely folded three sections of the strip conductor part.

The section C is folded over according to the arrow P7 illustrated in FIG. 10 and placed around an edge of the upper part 4 so that the result is the arrangement illustrated in FIG. 11 in which however, the upper part 4 is not illustrated for reasons of simplicity. It can be seen here that the annular strip conductor 18 and the sections of the individual strip conductors 10*a* to 17*a* extend on the side turned away from the upper part 4 as has been indicated by the dashed lines.

As illustrated in FIGS. 12 to 15, the section C is inserted preferably through a recess 21 of the upper part 4 of the receiving device 3. However, in order to facilitate the manufacturing process of the upper part 4, it is feasible to guide the bending region 35 around a trailing edge 21' of the upper part 4 as indicated schematically by the broken line in FIG. 12.

The recess (FIGS. 12, 13) of the sections B and C corresponding to the stand-by position 22 is marked with 22".

Figure 16:
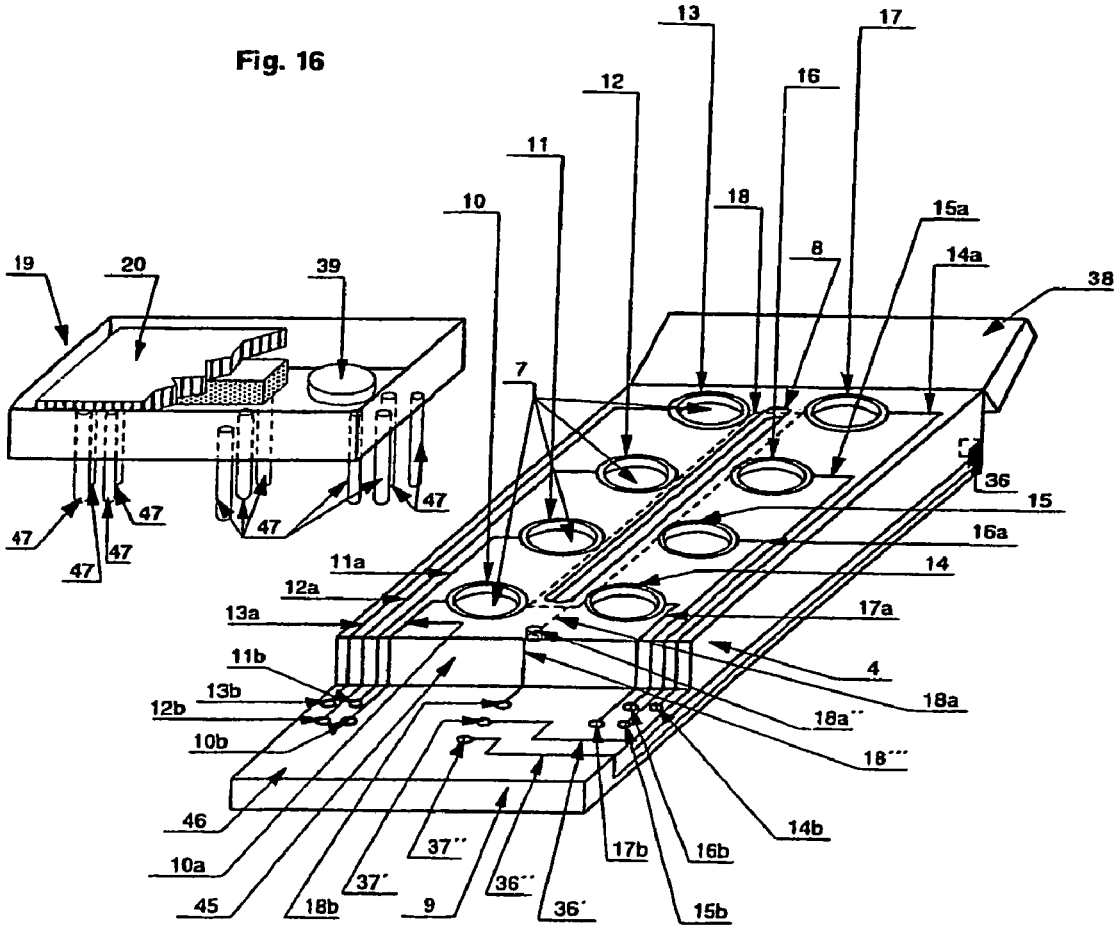
FIGS. 16 and 17 illustrate a particularly robust embodiment of the present invention.
Figure 17:
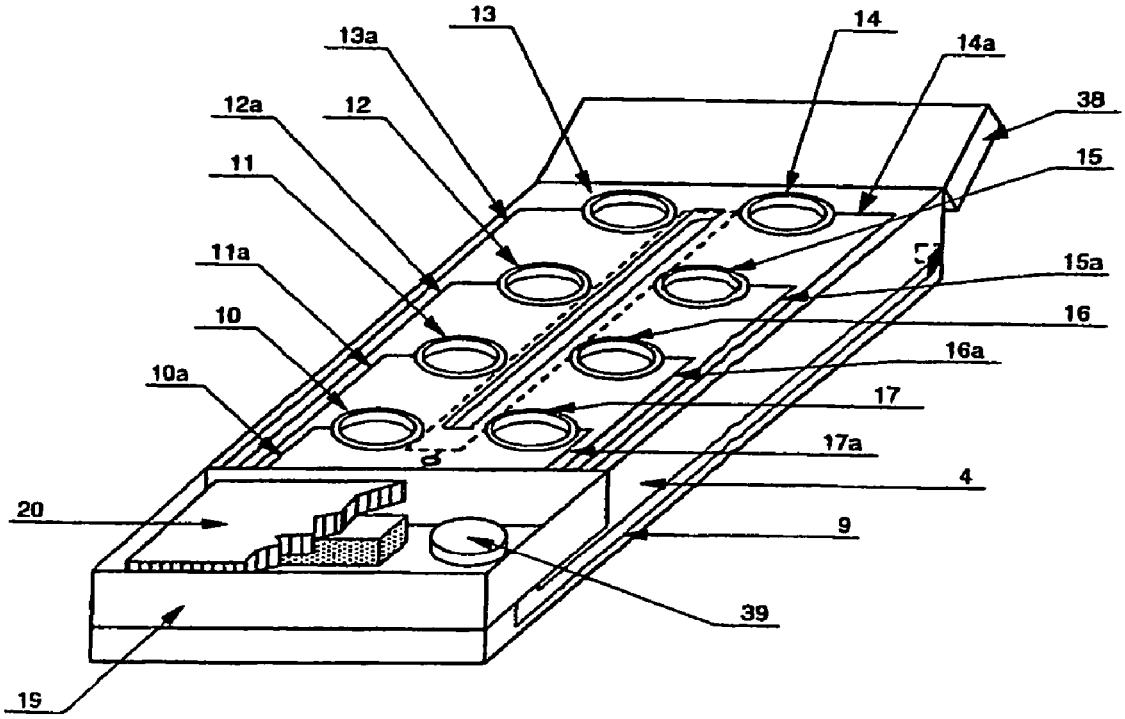

In conjunction with the FIGS. 16 and 17, an embodiment of the present blister pack system is explained that is provided with a relatively compact design. Details of the FIGS. 16 and 17 have the same markings that they were provided with in connection with the other figures.

This embodiment of the blister pack system essentially consists of an upper part 4 and a bottom part 9 that can be connected to one another permanently as a single piece. As has been explained in connection with the FIGS. 2 to 5, the upper part 4 comprises the ejection openings 7 corresponding to the pattern of the blister pack 1 and the associated individual contact surfaces 10 to 17 and the guide slot 8 in one plane.

The blister pack 1 is inserted preferably in the direction of the guide slot 8 when seen from a side of the blister pack system between the upper part 4 and the bottom part 9 of the same. For this purpose, preferably a flap 38 is provided on one side that can be opened for inserting the blister pack and that can be deviated after the insertion into a position in which the insertion opening is closed. As illustrated schematically, a switching device 36 can be provided in the region of the flap 38. Said switching device 36 activates at least one, preferably two contacts when the flap 38 closes that are connected via strip conductors 36' and 36" to connection contact elements 37', 37". Said contact elements 37', 37" are preferably located on the other side of the blister pack system that lies opposite to the flap 38 and are connected to a control/computing unit 19 in a manner that is explained more elaborately later on. As has been explained earlier, the control/computing unit 19 contains, among others, a display 20 and the corresponding electronics. As illustrated particularly in FIG. 16, the control/computing unit 19 is received in a receiving region of the upper part 4 that lies preferably opposite to the flap 38 so that the control/computing unit 19 arranged in the receiving region, the upper part 4 and the bottom part 9 have a preferably cuboid shape. Preferably a step 45 is located between the surface of the base part 46 of the receiving region in which said connection contact elements 37', 37" of the switching device 36 are arranged and the upper surface of an upper wall part of the upper part 4. Said step 45 can correspond to the thickness of the module of the control/computing unit 19 and can extend vertically or obliquely to the preferably parallel surface of the base part 46 of the receiving region and the surface of the upper part 4.

As described above, an individual strip conductor 10*a* to 17*a* extends from every individual contact surface 10 to 17 first on the surface of the wall part of the upper part 4, then over at least one surface of the receiving region for the control/computing unit 19.

Every individual strip conductor 10*a* to 17*a* ends preferably in the area of the base part 46 in an individual contact point 10*b* to 17*b*.

The common contact 18 extends annularly around the guide slot 8 on the side of the upper surface of the wall part of the upper part 4 that lies opposite to the individual contact surfaces 10 to 17. The common contact 18 is connected to a first region 18*a* of a common strip conductor that extends to a through-connection 18*a*" that connects a connection between the first segment 18*a* and a second segment 18*a*'" of the common strip conductor. Said first segment 18*a* extends on the lower surface of the wall part of the upper part 4. Said second segment 18*a*'" extends from the through-connection 18*a*" via at least one surface of the receiving region for receiving the control/computing unit 19. This second segment 18'" of the common strip conductor leads to a common contact point 18*b* preferably in the area of the base part 46.

Said strip conductor routing helps achieve a complete electrical decoupling of the individual strip conductors 10*a* to 17*a* and of the connected individual contact points 10*b* to 17*b* from the common contact surface 18 and the corresponding regions 18*a* and 18*a*'" of the common strip conductor. Said complete electrical decoupling also helps completely eliminate the possibility of an undesired connection between these components caused by a tinfoil or the like. What is of significance here is that the housing of the control/computing unit 19 protectively covers non-insulated strip conductors and contact points in the receiving regions, e.g., in the step 45 and the base part 46 when the housing is arranged in the receiving region.

According to the illustrated embodiment, the connection contact elements 37', 37" and the contact points 10*b* to 17*b* and 18*b* can be designed as socket contacts so that the connection contact pins 47 of the control/computing unit 19 can be inserted into them for contact-making when the contact pins are inserted into the receiving region.

The embodiment explained above is a particularly robust design-form in which the strip conductors can be mounted in the form of lattice-shaped punched out copper parts.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A blister pack system comprising:

an upper part having ejection openings and a bottom part having ejection openings, between which a blister pack having pouches is disposed, the pouches being aligned with corresponding ejection openings of the upper part and corresponding ejection openings of the bottom part, with every ejection opening of the upper part being associated with an individual contact surface that is connected to a control/computing unit via an individual strip conductor; and an ejection device including a peg section that is movable in a guide slot and a top section having a pusher section that is insertable into the ejection opening of the upper part that is associated with the pouch for removing an item therefrom, with a common contact surface that is connectable via a common strip conductor to the control/computing unit, the common contact surface being associated with the guide slot, the ejection device including a first electrical contact element at the top section and a second electrical contact element at the peg section, with the second electrical contact element being electrically connected to the first electrical contact element, the individual contact surfaces and the individual strip conductors associated therewith on one side of the upper part and the common contact surface and the common strip conductor associated therewith or a subsection thereof on another side of the upper part extending in surfaces of the upper part that are electrically insulated from each other, at least one of the individual strip conductors or the common strip conductor being through-connected to the other side of the upper part and being connected to the control/computing unit, the individual contact surfaces, the individual strip conductors, and individual contact points, connected to the individual strip conductors and the common contact point, connected to the common strip connector being disposed on a side of the upper part that is turned away from the bottom part, the common contact surface and a first region of the common strip conductor being disposed on a side of the upper part that is turned towards the bottom part, and the first region of the common strip conductor being electrically connected via a through-connection of the upper part to a second region of the common strip conductor that extends on the side of the upper part that is turned away from the bottom part to the common contact point.

2. The blister pack system according to claim 1, wherein at least one of the individual strip conductors and the common strip conductor is at least partially covered by an electrically insulating layer.

3. The blister pack system according to claim 1, further comprising a receiving region for a housing of the control/computing unit and an interface arranged therein to individual contact points of the individual contact surfaces and to a common contact point of the common contact surface.

4. The blister pack system according to claim 1, wherein the control/computing unit includes electrical contact elements that are insertable into the socket-shaped individual contact points and the common contact point formed in the upper part.

5. The blister pack system according to claim 1, wherein the upper part includes a receiving region for receiving the control/computing unit, the individual connection contact points and the common contact point are arranged in an interface region of the receiving region, the individual strip conductors extend from the surface of the upper part to the interface region of the receiving region over at least one surface of the receiving region to the control/computing unit, the second region of the common strip conductor extends starting from the through-connection protruding from the surface of the upper part over at least one surface of the receiving region to the interface region such that the housing of the control/computing unit protectively covers at least one sub-area of the receiving region and at least the electrically non-insulated sub-sections of the individual strip conductors and the sub-section of the second section of the common strip conductor whereby said sub-sections extend in the receiving region, and the housing of the control/computing unit further protectively covers the sub-sections of the individual strip conductors that extend in the area of a base part of the receiving region, the sub-section of the second section of the common strip conductor that extends in the area of the base part of the receiving region, the individual contact points, and the common contact point when said housing is inserted into the receiving region.

6. The blister pack system according to claim 1, wherein on the side that is turned away from the control/computing unit, the system includes an insertion opening for the blister pack that can be closed using a flap and a switching device that indicates a state of the flap in which the insertion opening is closed, said switching device being connected via strip conductors to contact points that are arranged in the interface region of the receiving region.

7. The blister pack system according to claim 1, wherein the individual contact surfaces, the individual strip conductors, the second region of at least one of the common strip conductors and the common contact surface, and the first region of the common strip conductor are configured as metal strips that are attached with a glue on the corresponding surfaces of the upper part.

8. The blister pack system according to claim 5, wherein the through-connection is arranged in the protected region of the receiving region.

9. The blister pack system according to claim 1, wherein a strip conductor part includes at least a first section that is connected to a second section via a bending region, the first section and the second section include ejection openings and a guide slot corresponding to a pattern of the blister pack such that if the first section and the second section are bent around the bending region in planes that are parallel to one another, the ejection openings and the guide slot of the first section and the ejection openings and the guide slot of the second section are aligned with one another, the first section includes the individual contact surfaces in the region of the ejection openings on a first side that is turned away from the bottom part in an assembled state, the individual strip conductors extend starting from the individual contact surfaces over the first section and the first side of the second section to the individual contact points arranged on the second section, the common strip conductor extends on the first side of the second section starting from the common contact surface of the second section to a common contact point on the first side of the second section, and the first section and the second section are attached to the upper part such that the strip conductor part extends in the bending region around an edge of the upper part such that the ejection openings and the guide slot of the first section and the ejection openings and the guide slot of the second section are aligned with the ejection openings and the guide slot of a wall part of the upper part.

10. The blister pack system according to claim 9, wherein the individual contact points and the common contact point are arranged on the second section in a row extending transversely to a longitudinal extension of the guide slot of the second section on the side of the guide slot of the second section that is turned away from the first section.

11. The blister pack system according to claim 9, wherein in the assembled state, the first side of the first section that is turned towards the bottom part and the side of the second section that is turned away from the bottom part are attached by a glue to the upper part.

12. The blister pack system according to claim 9, wherein the first section and the second section are bent in the bending region around a trailing edge of the upper part.

13. The blister pack system according to claim 9, wherein the upper part includes a recess extending transversely to the guide slot, and one edge of the bending region extends around said recess.

14. The blister pack system according to claim 9, wherein the first section of the strip conductor part is connected on the side that is turned away from the section along a bending line to a third section that includes ejection openings and a guide slot such that when the third section is congruently bent along the bending line onto the first section, the ejection openings and the guide slot of the third section are aligned with the ejection openings and the guide slot of the first section, and the third section protectively covers the individual strip conductors in the region of the first section while the individual contact surfaces in the ejection openings of the third section are exposed.

15. The blister pack system according to claim 14, wherein the third section is attached by a glue to the first section.

16. The blister pack system according to claim 9, wherein the strip conductor part has a flexible plastic material construction.

17. The blister pack system according to claim 1, wherein the individual contact surfaces have a shape of elements that annularly surround the ejection openings.

18. The blister pack system according to claim 1, wherein the common contact surface has a shape of an element surrounding the guide slot annularly.

19. The blister pack system according to claim 1, wherein the peg section of the ejection device includes a sliding part that slides on an edge region of the guide slot and a holding part separated from the sliding part on which the second contact element that is resilient in the axial direction of the peg section is arranged, whereby the peg section penetrates the guide slot.

20. The blister pack system according to claim 19, wherein the top section is connected to the peg section via a part that can be pivoted around an axis extending transversely to an axis of the peg section in the region of the peg section that projects over the sliding part.

21. The blister pack system according to claim 1, wherein the contact element of the top section has an annular configuration and extends around the ejection pusher.

22. The blister pack system according to claim 1, wherein the second contact element of the peg section has an annular configuration and extends around the peg section.

* * * * *